US005729798A

United States Patent [19]

Yasui et al.

[11] Patent Number: 5,729,798

[45] Date of Patent: Mar. 17, 1998

[54] HEAT ROLLER FIXING DEVICE HAVING POSITIONING MEMBERS

[75] Inventors: Motokazu Yasui; Yasuhisa Kato, both of Yokohama, Japan

[73] Assignee: Ricoh Company, Ltd., Tokyo, Japan

[21] Appl. No.: 803,216

[22] Filed: Feb. 20, 1997

Related U.S. Application Data

[63] Continuation of Ser. No. 487,641, Jun. 7, 1995, abandoned, which is a continuation of Ser. No. 190,495, Feb. 2, 1994, Pat. No. 5,481,350.

[30] Foreign Application Priority Data

Apr. 12, 1993 [JP] Japan ..... 5-084221
Apr. 12, 1993 [JP] Japan ..... 5-084222

[51] Int. Cl.[6] ..... G03G 15/16

[52] U.S. Cl. ..... 399/122

[58] Field of Search ..... 219/216, 469; 399/122, 330, 331

[56] References Cited

U.S. PATENT DOCUMENTS

| | | | |
|---|---|---|---|
| 4,395,109 | 7/1983 | Nakajima et al. . | |
| 4,782,359 | 11/1988 | Tomoe | 355/282 |
| 4,839,694 | 6/1989 | Kawashima et al. . | |
| 4,899,197 | 2/1990 | Davis et al. | 355/290 |
| 5,115,119 | 5/1992 | Adachi et al. . | |
| 5,179,415 | 1/1993 | Ikematsu et al. | 355/290 |
| 5,189,480 | 2/1993 | Hoover et al. | 355/282 |
| 5,291,256 | 3/1994 | Kitajima et al. | 355/290 |
| 5,301,000 | 4/1994 | Heigl | 355/290 |
| 5,481,350 | 1/1996 | Yasui et al. | 355/290 |

FOREIGN PATENT DOCUMENTS

| | | |
|---|---|---|
| 3119522 | of 0000 | Germany . |
| 62018581 | of 0000 | Japan . |

OTHER PUBLICATIONS

WPAT, AN 88-221161/32, DE-A-38 01 859, Aug. 4, 1988.

*Primary Examiner*—Robert Beatty
*Attorney, Agent, or Firm*—Oblon, Spivak, McClelland, Maier & Neustadt, P.C.

[57] ABSTRACT

A heat roller fixing device has a fixing roller into which a heater is built and a pressing roller which rotatably presses on the fixing roller so that a non-fixed image is fixed on a paper sheet in a nip between the fixing roller and the pressing roller. It also includes a first frame for rotatably supporting the fixing roller, a second frame for rotatably supporting the pressing roller, a harnesses, a temperature detecting device, a safety device and a connector which are provided on the first frame. Positioning members on the first frame position the fixing device relative to the frame. The positioning members are horizontally located on a line passing through the center of the fixing roller.

13 Claims, 12 Drawing Sheets

HEAT ROLLER FIXING DEVICE HAVING POSITIONING MEMBERS

This application is a Continuation of application Ser. No. 08/487,641, filed on Jun. 7, 1995, now abandoned, which is a continuation application of Ser. No. 08/190,495 filed on Feb. 2, 1994, now U.S. Pat. No. 5,481,350.

BACKGROUND OF THE INVENTION

1. Field of the Invention

This invention relates to a heat roller fixing device for a recording device such as a copier or a printer, especially to a heat roller fixing device having a divided structure which comprises an upper part forming a fixing roller side and a lower part forming a pressing side.

2. Description of the Related Art

As shown in FIG. 12, a heat roller fixing device generally has a fixing roller 2 with a built-in heater 1 and a pressing roller 4 which is mounted via a pressing lever so as to press the fixing roller 2.

A paper sheet 6 with a non-fixed toner image 5 is transported from a transferring part (not shown) and is passed through the nip between the fixing roller 2 and the pressing roller 4 while inlet guides 7*a*, 7*b* guide the paper sheet 6. Thereby, the non-fixed toner image is melted and fixed on the paper sheet 6. The paper sheet 6 with the fixed toner image thereon is separated from the fixing roller 2 by a separating pick 8, which is arranged so that the top of the separating pick 8 is in contact with the peripheral surface of the fixing roller 2. Further, the paper sheet 6 with the fixed toner image thereon is discharged to a discharging tray (not shown) by a pair of paper discharging rollers 10, while being guided by sheet discharging guides 9*a* and 9*b*.

In such heat roller fixing devices, one end of each of the fixing roller 2 and the pressing roller 4 is provided on a front side plate which is mounted to the front plate of the main body of the recording device, and the other end of each of the fixing roller 2 and the pressing roller 4 is provided on a back side plate which is provided at a driving side having a fixing roller driving element.

When the pair of rollers are assembled, one of the ends of these rollers are first inserted into holes of the back side plate. Next, the other ends of the rollers must be set into the front side plate after these rollers are slid along their lengths. As a result, it is not easy to set and operate the fixing device.

Recently, by making a frame of the fixing device using plastic, the costs have been decreased. Further, a divided structure which comprises an upper part (a fixing roller frame) forming a fixing roller side and a lower part (a pressing roller frame) forming a pressing side, has been put into practice to make it easy to assemble the fixing device.

As shown in FIG. 13(*a*), the upper part of the divided structure for the fixing roller is mainly made of a fixing frame 11 having a recess rotatably holding the fixing roller 2 the recess being formed on the fixing frame 11. (As the fixing frame 11 is set after turning it over, the fixing roller 2 is initially supported so as not to drop.)

The divided structure of the pressing roller side (FIG. 13(*b*)) also is mainly made of a pressing frame 12 for rotatably holding the pressing roller 4 by a recess which is formed in the pressing frame 12.

The frames 11 and 12 are integrated by screws, etc., to form a fixing device. It is easy to set each of these rollers 2 and 4 into its respective frame 11 or 12 via the recesses in the frames.

However, it is difficult in these fixing devices to correctly position the fixing roller 2 and/or the pressing roller 4 relative to the main body, or to make the rollers 2 and 4 precisely parallel. As a result, troubles (such as wrinkles on a paper sheet, a paper jam in the fixing device and jitters) occur if the positioning of the units is not accurate.

Further, it is difficult to assemble the fixing device if harnesses for connecting the heater to a connector from the main body are provided in the pressing roller unit. That is, after the pressing roller unit and the fixing roller unit are made separately and are integrated, the harnesses must be wired between the fixing roller unit and the pressing roller unit. Furthermore, it is difficult to automatically assemble these units on lines in the factory, so that the cost increases.

SUMMARY OF THE INVENTION

The present invention has as an object to overcome the above and other problems encountered in the aforementioned art.

It is a further object of the present invention to provide a heat fixing device having a divided structure.

It is still a further object of the present invention to provide a heat fixing device which is easily assembled.

It is still a further object of the present invention to provide a heat fixing device which correctly positioned.

The above-mentioned objects of the present invention are achieved by a heat roller fixing device having a fixing roller into which a heater is built and a pressing roller which rotatably presses on the fixing roller, wherein a non-fixed image is fixed on a paper sheet in a nip between the fixing roller and the pressing roller. The heat roller fixing device includes a first frame for rotatably supporting the fixing roller, a second frame for rotatably supporting the pressing roller, a detecting part for detecting the temperature on the surface of the fixing roller, a safety device for preventing the temperature from exceeding a predetermined value, a connector for electrically connecting the heat roller fixing device to a main body, and harnesses for electrically connecting between the heater and connector or safety device, wherein the detecting part, the safety device he connector and the harness are provided on the first frame.

Since the main parts, including the connector and harnesses, etc., are on the first frame, it is easy to handle the device.

According to a further feature of the invention, a heat roller fixing device has a fixing roller in which a heater is built and a pressing roller which rotatably presses the fixing roller, wherein a non-fixed image is fixed on a paper sheet in a nip between the fixing roller and the pressing roller. It also includes a first unit for rotatably supporting the fixing roller and a second unit for rotatably supporting the pressing roller, wherein at least one positioning member is provided only on said first unit.

Since the positioning members are provided only on the first frame, it is assured that the fixing roller unit is positioned on the main body. Since the pressing roller unit is positioned to follow the fixing roller unit, it is assured that the fixing roller and the pressing roller are parallel and it is possible to prevent wrinkles in paper sheets and paper jams from occurring.

BRIEF DESCRIPTION OF THE DRAWINGS

Other objects and further features of the present invention will become apparent from the following detailed description when read in conjunction with the accompanying drawings, wherein.

DESCRIPTION OF THE PREFERRED EMBODIMENTS

A description will now be given of preferred embodiments of a heat fixing roller device according to the present invention.

A first embodiment according to the present invention will be explained with reference to FIGS. 1 to 9.

Figure 2:
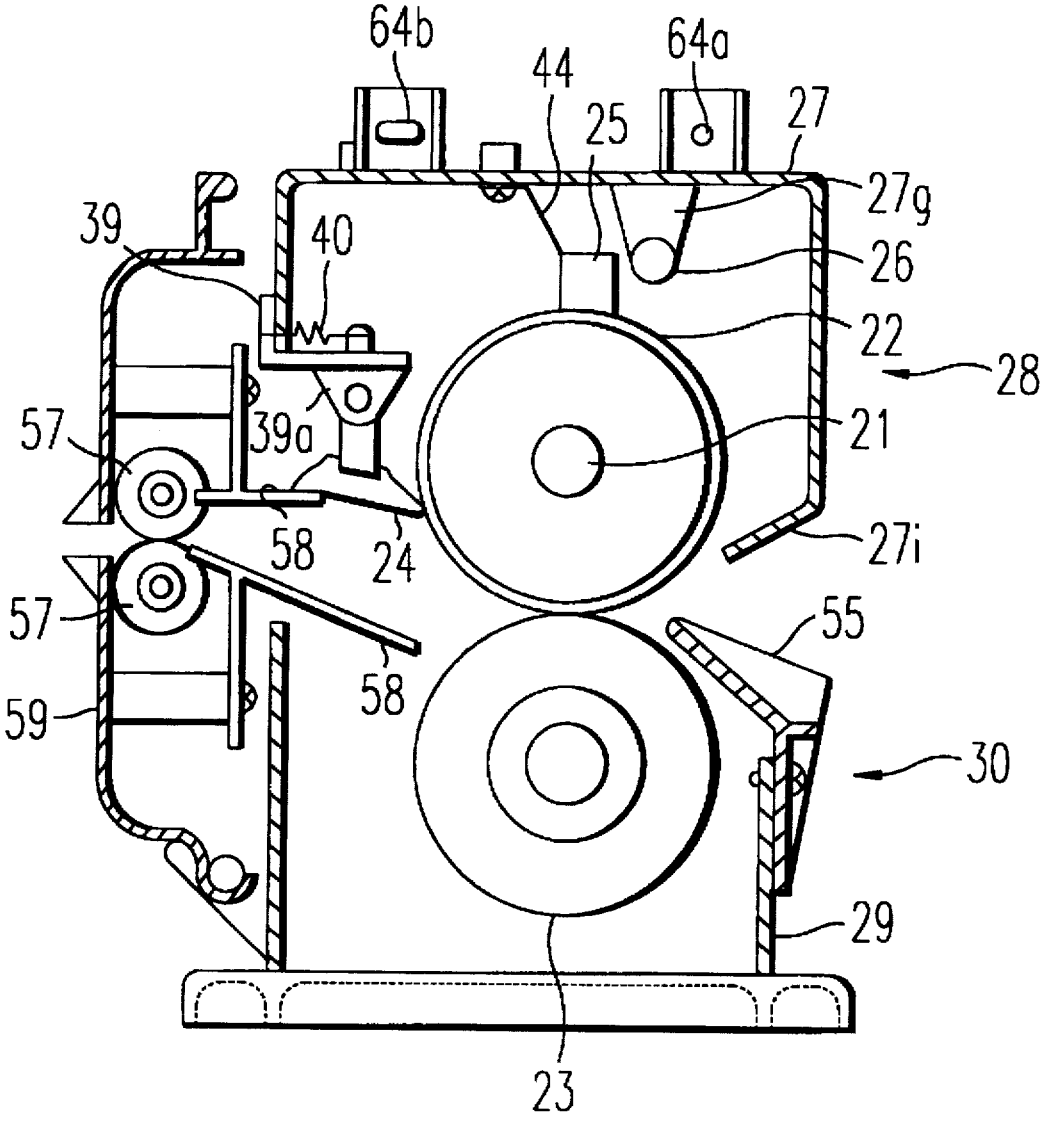
FIG. 2 is a longitudinal sectional front view showing a structure of a fixing device.

As shown in FIG. 2, a heat roller fixing device which is divided into two units is mainly made of a fixing roller 22 having a heater 21 inside and rotating clockwise, and a pressing roller 23 which is located under the fixing roller 22. The pressing roller 23 is contacted with the fixing roller 22 with a predetermined pressure by a pressing mechanism and rotates counterclockwise. Separation claws 24 for preventing a paper sheet, on which an image is fixed, from winding on the fixing roller 22 are provided around the fixing roller 22 and downstream from the nip between the rollers. As a detecting device; a thermistor 25 for detecting the temperature on the surface of the fixing roller 22 is provided in contact with an outer surface of the fixing roller 22. Based on the temperature information from the thermistor 25, the temperature of the fixing roller 22 is controlled by a conventional (non-illustrated) controller. Further, as a safety device, a temperature fuse 26 for preventing the temperature of the fixing roller 22, (that is the heater 21) from exceeding a predetermined value is provided around the fixing roller 22. An excessive temperature will cause the fuse to open and short circuit the power to the heater 21.

The fixing roller 22, the separating claws 24, the thermistor 25 and the temperature fuse 26, which comprise a fixing roller unit 28, are disposed on a first frame 27. On the other hand, the pressing roller 23 and the pressing mechanism, which comprise a pressing roller unit 30, are provided on a second frame 29. The first and second frames 27 and 29 are held integrally by screws as will be described in detail below.

Figure 1:
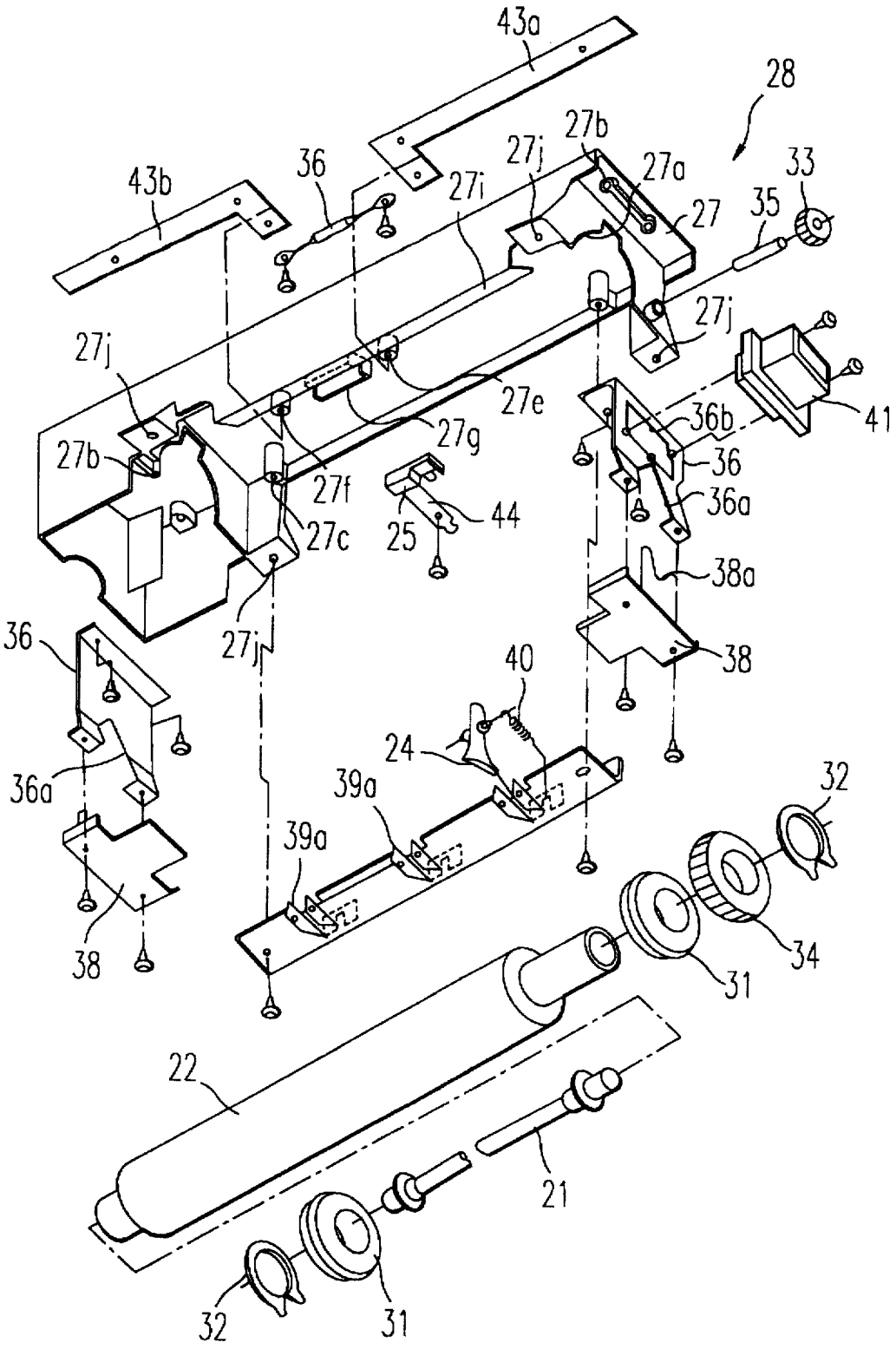
FIG. 1 is an exploded perspective view showing a fixing roller unit according to an embodiment of the present invention.
Figure 3:
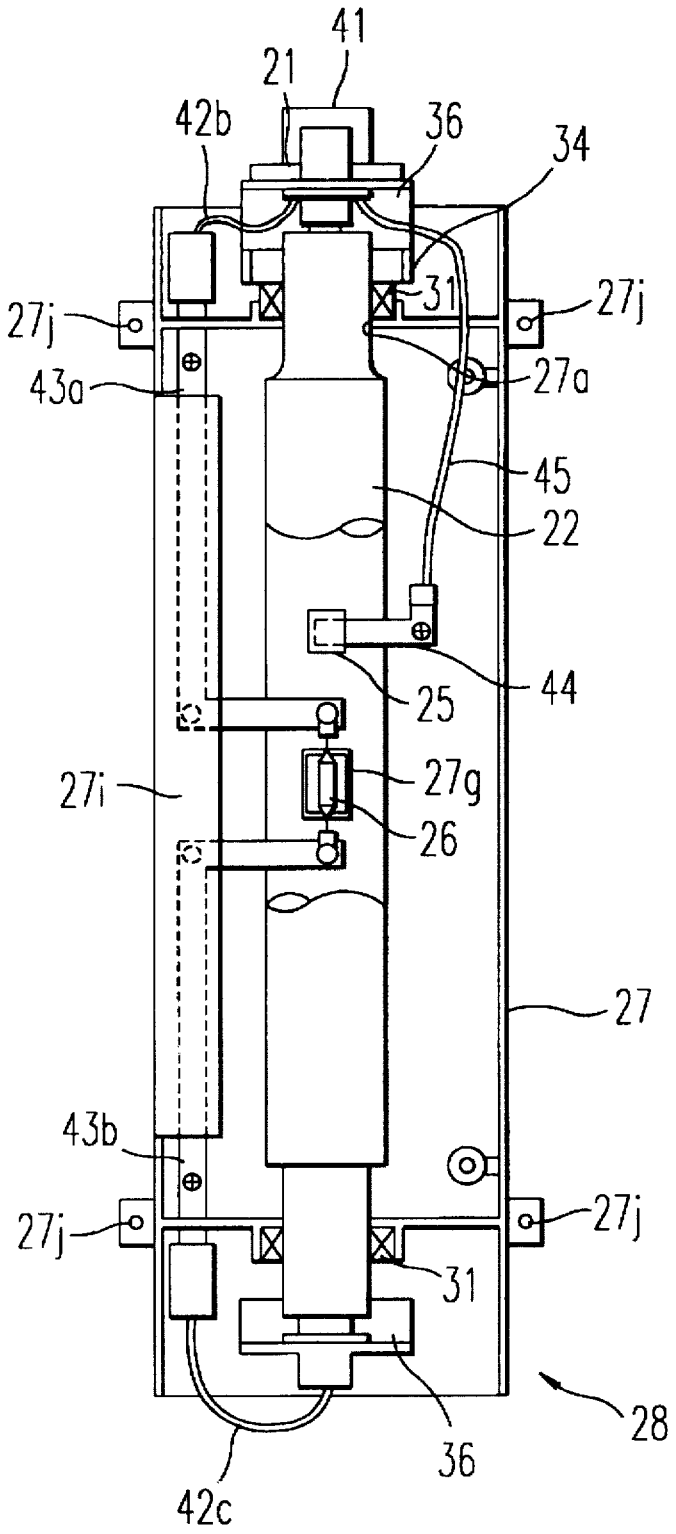
FIG. 3 is a schematic plan view of the fixing device.

A description will now be given of a structure of the fixing roller unit 28, referring to FIGS. 1 and 3.

The first frame 27 is longer than the fixing roller 22 and is made of heat-resistant resin. U-shaped recesses 27*a* for rotatably holding smaller diameter portions on both ends of the fixing roller 22 are formed in both ends of the fixing roller unit 28. On the ends of the smaller diameter portions of the fixing roller 22 are provided bearings 31 and rings 32 for rotatably supporting the fixing roller 22 and preventing it from coming off from the U-shaped recesses 27*a*. A driving gear 34 is disposed on the one end of the fixing roller 22, which is connected to a driving mechanism (not shown) via an idle gear 33. The idle gear 33 is disposed on an end plate at the driving side of the first frame 27 by a pin 35. Heater supporting plates 36 (a supporting member), each having a V-shaped recess 36*a* for supporting an end of the heater 21 built in the fixing roller 22, is mounted on each mounting boss 27*b* of an upper face of the first frame 27 by screws. Further, V-shaped recesses 38*a* for sandwiching the ends of the heater 21, which recesses 38*a* pair up with the recesses 36*a*, are formed on a heater holding plate 38 which is mounted on the heater supporting plate 36 by screws.

Several separating claws 24 are spaced in the direction of the axis of the fixing roller 22, and are pivotally supported in slots on a bracket 39 via set up pieces 39*a* which are L-shaped in sectional view and are formed on the bracket 39. The bracket 39 is mounted integrally with the fixing roller unit 28 by disposing the bracket 39 on mounting bosses 27*c* of the upper face of the first frame 27 using screws. Ends of springs 40 are respectively connected to the separating claws 24 and the bracket 39 so as to press the tops of the separating claws 24 onto the fixing roller 22.

The thermistor 25 and the temperature fuse 26 are provided on the upper surface of the first frame 27, together with harnesses for securing electrical connections. An opening 36*b* for holding a connector 41 via screws is formed on the heater supporting plate 36 at a back (driving) side of the fixing device. One end of the heater 21 is electrically connected to the main body of the recording device by the connector 41 and a lead wire 42*b* with a socket (not shown). The lead wire 42*b* with a socket is connected to the connector 41 and is also connected to the other end of the heater 21 through two harnesses 43*a*, 43*b*, the fuse 26 and a lead wire 42*c* with a socket. The lead wire 42*c* thus electrically connects the other end of the harness 43*b* to the other end of the heater 21. The electrical power circuit for the heater 21 therefore includes the fuse 26 and will be shorted if the fuse opens.

The harnesses 43*a*, 43*b* are strip-shaped and suitably bent. The harnesses 43*a*, 43*b* are disposed on the first frame 27 by mounting bosses 27*e*, 27*f*, etc., formed in the upper face of the first frame 27 and by screws. The temperature fuse 26 is fixed on holding portion 27*g* and between harnesses 43*a*, 43*b* so that the temperature fuse 26 is positioned at a predetermined position of the fixing roller 22 while being electrically connected to the harnesses 43*a*, 43*b*. The thermistor 25 is disposed by a screw on the upper face of the first frame via a thermistor supporting member 44 which is a strip-shaped spring. Further, the thermistor 25 is electrically connected to the main body through the connector 41 by a lead wire 45 with a socket (connecting member).

An inlet guide 27*i* is formed by being bent at a lower part of the first frame 27. Further engaging pieces 27*j*, for engaging integrally the first frame 27 with the second frame 29 using screws, are formed on four corners of a lower end of the first frame 27.

Figure 4:
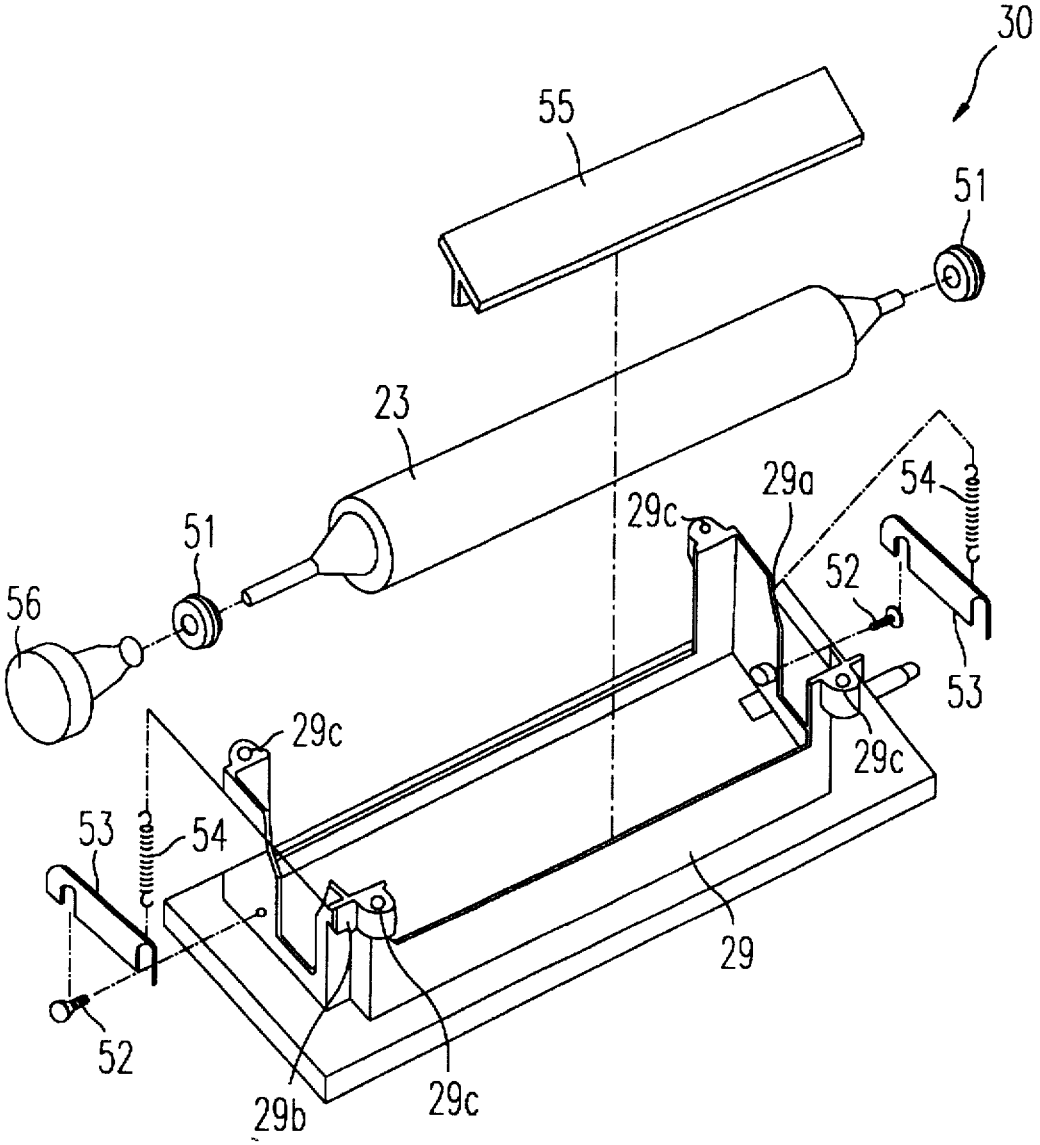
FIG. 4 is an exploded perspective view of a pressing roller unit.
Figure 5:
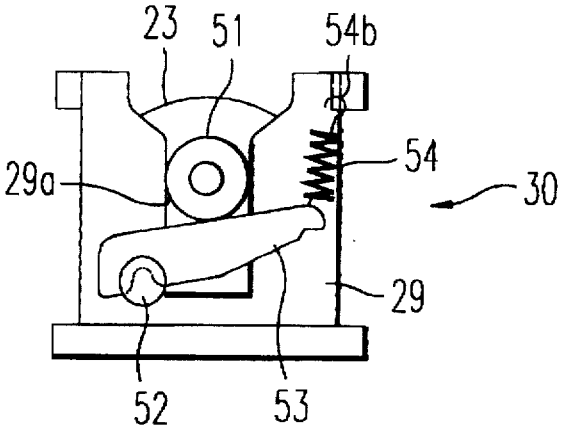
FIG. 5 is a schematic front view of the pressing roller unit.

The structure of the pressing roller unit 30 will be explained below with reference to FIGS. 4 and 5. The second frame 29 has almost the same length as does the pressing roller 23 and is made of heat-resistant resin. On both end plates of the second frame in a longitudinal direction, recesses 29*a* (removed portions of the second frame) are formed to rotatably (and upward and downward) support bearings 51 which are formed on smaller diameter portions of both ends of the pressing roller 23. On the end plates of the second frame 29, stepped screws 52 are provided as fulcrums for rotatable pressing levers 53 (a pressing member). The pressing levers are located under the pressing roller 23 (the bearing 51), and springs 54 which are provided between hooking pieces 29*b* of the second frame 29 and the pressing levers 53 press the press the roller 22 the fixing roller 22. An inlet guide 55 is mounted on the second frame 29 by screws, and a knob 56 is provided on one end of the pressing roller 23. Further, mounting portions 29*c* are formed corresponding to engaging pieces 27*j* at four corners of upper end of the second frame 29.

The pair of discharging rollers 57 and outlet guides 58, etc., are supported via a paper discharging cover 59 by the second frame 29 of the pressing roller unit 30, as shown in FIG. 2.

In the divided structure according to the first embodiment, only the pressing roller 23 and the pressing lever 53, etc. (the pressing mechanism), are provided on the second frame 29. Almost all other elements, including the electrical connections, are provided on the first frame 27.

Figure 6:
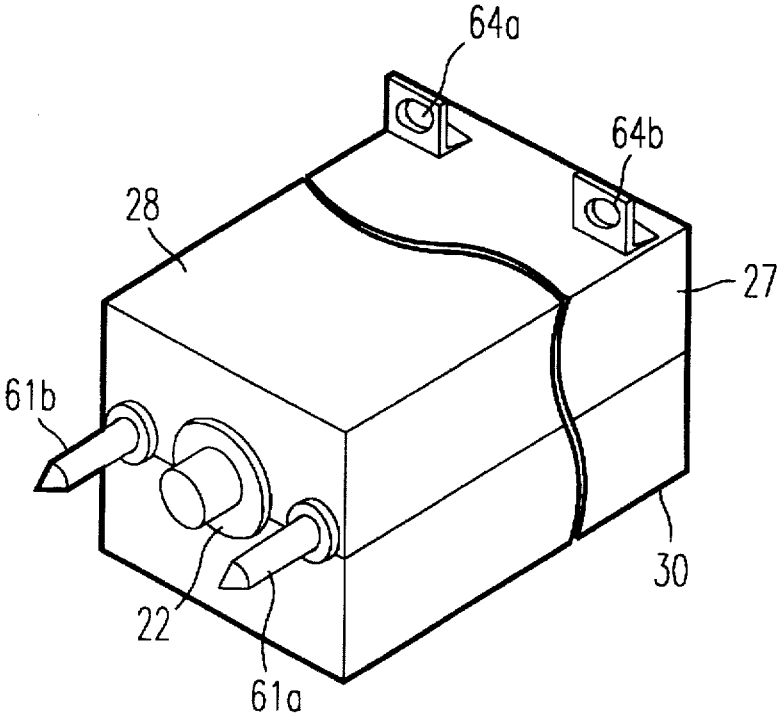
FIG. 6 is a schematic perspective view of the fixing device.
Figure 7:
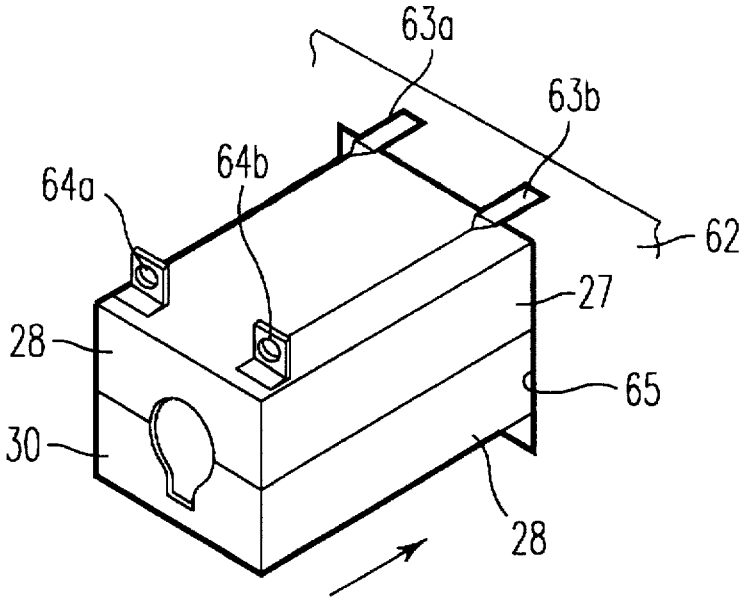
FIG. 7 is a schematic perspective view of the fixing device which is being inserted into a main body.

The positioning members for attachment to the main body is provided only on the fixing roller unit 28 (the first frame 27). Namely, as shown in FIG. 6, on the first frame 27 are integrally provided two positioning pins 61*a*, 61*b* which are held in two positioning holes (not shown) provided in the driving side, i.e., the side having the driving gear 34. Further, on the first frame 27 are integrally provided two brackets having positioning holes 64*a*, 64*b* into which two positioning pins 63*a*, 63*b* provided on the front panel 62 of the main body of the recording device are inserted (refer to FIG. 7). An opening 65 for inserting the fixing device is formed on the front panel 62 of the main body.

Figure 8:
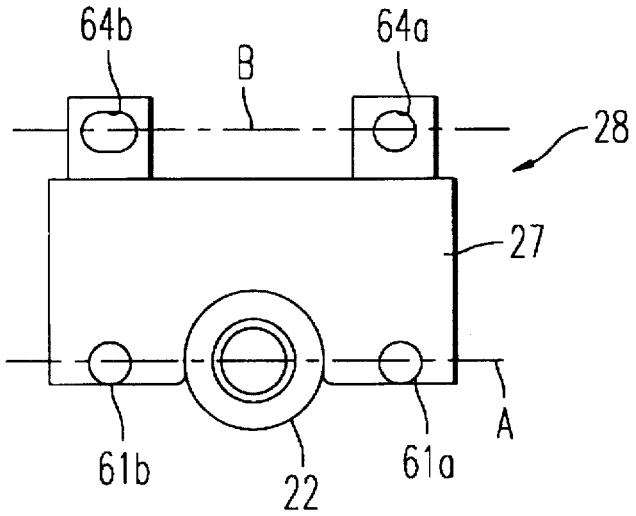
FIG. 8 is a schematic rear view of the fixing roller unit.

Description will now be given of these positioning members in detail. The positioning pins 61*a*, 61*b* are disposed on the end plate in the connector side (i.e., the side having the driving gear 34) of the first frame 27 and oppose each other. These pins 61*a*, 61*b* are located at opposite sides of a vertical line which passes through the center of the fixing roller 22, and on a horizontal line which passes through the center of the fixing roller 22 as shown in FIG. 8. On the other hand, the positioning holes 64*a*, 64*b* are formed in positioning brackets which are provided on an upper face of the first frame 27 and are located at opposite sides of a vertical line which passes through the center of the fixing roller 22, and as far from this vertical line as possible. As shown in FIG. 8, the line "A" which extends between the positioning pins 61*a*, 61*b* which are located in the driving side and the line "B" which extends between the positioning holes 64*a*, 64*b*which are located in the side of the front panel 62 are parallel (or almost parallel) to one another. As shown in the plan view of the FIG. 9, the line "C" which extends between the positioning pin 61*a* and the positioning hole 64*a*, and the line "D" which extends between the positioning pin 61*b* and the positioning hole 64*b* are parallel (or almost parallel) to one another.

As mentioned above, in the divided structure according to this embodiment, since the positioning relative to the main body is provided only in the side of the fixing roller unit 28, it is assured that the fixing roller 22 is correctly positioned relative to the main body. That is why the function of fixing is concentrated on the side of the fixing roller 22 and driving is also done on the side of the fixing roller 22. Accordingly, wrinkles and paper jams, etc. are prevented from occurring by the correct relation between the fixing roller 22 and the main body. On the side of the pressing roller 23, the pressing roller unit 30 is connected to the fixing roller unit 28, and so the pressing roller unit follows the fixing roller unit.

In view of the above, the strength against bending, average resin thickness and heat-resistant temperature of the first frame 27 is superior to these of the second frame 29. Bends may occur in at least one of the units when the first frame 27 and the second frame 29 are assembled, due to manufacturing tolerances. Since the first frame 27 is thicker and stronger than the second frame 29 in terms of bending-resistance, the bends do not occur in the first frame 27 when the first frame and the second frame are positioned to the main body. If bends occur in the second frame 29, risks are reduced in comparison with a case which the bends occur in the first frame 27. Since the fixing roller 22 which is heat at high temperature is provided in the first frame 27, the first frame must be made of heat-resistant resin, but the second frame 29 need not have high heat resistance in comparison with the first frame, because the second frame 29 does not directly hold the fixing roller 22. In the second frame 29, cheaper and lower heat resistance resin is used to lower costs.

Figure 9:
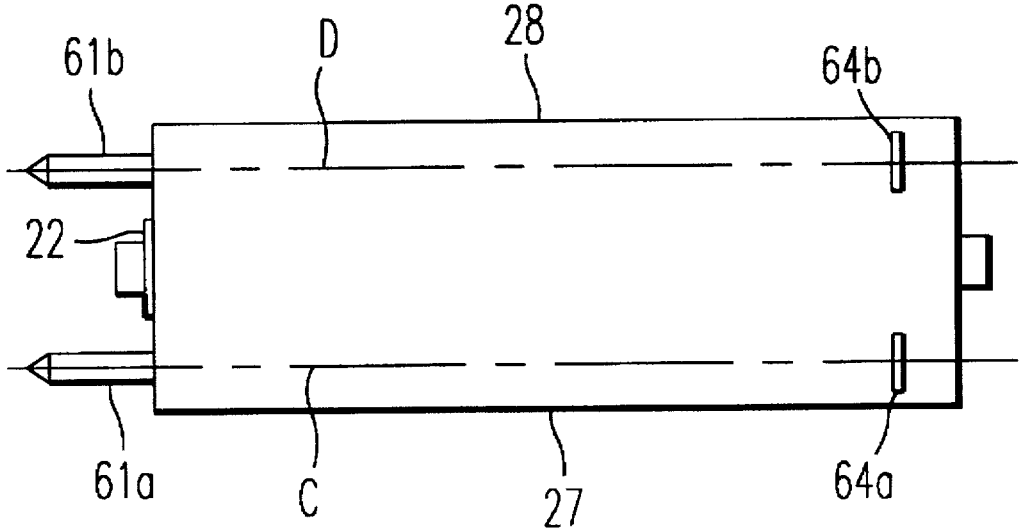
FIG. 9 is a schematic plan view of the fixing roller unit.

The reason why the positioning pins 61*a*, 61*b* and the positioning holes 64*a*, 64*b* are provided in the positions shown in FIGS. 6 and 9 will now be explained.

Figure 14:
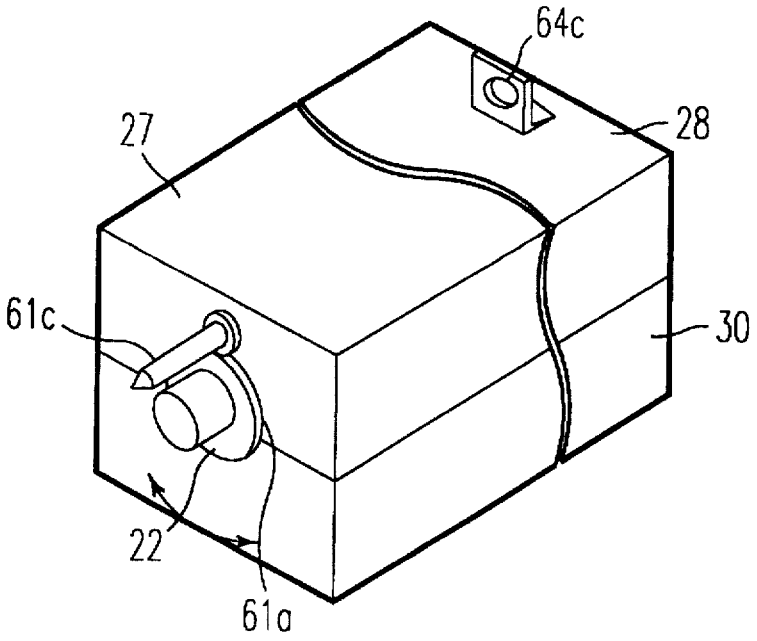
FIGS. 14 and 15 illustrate alternative embodiments of the invention.
Figure 15:
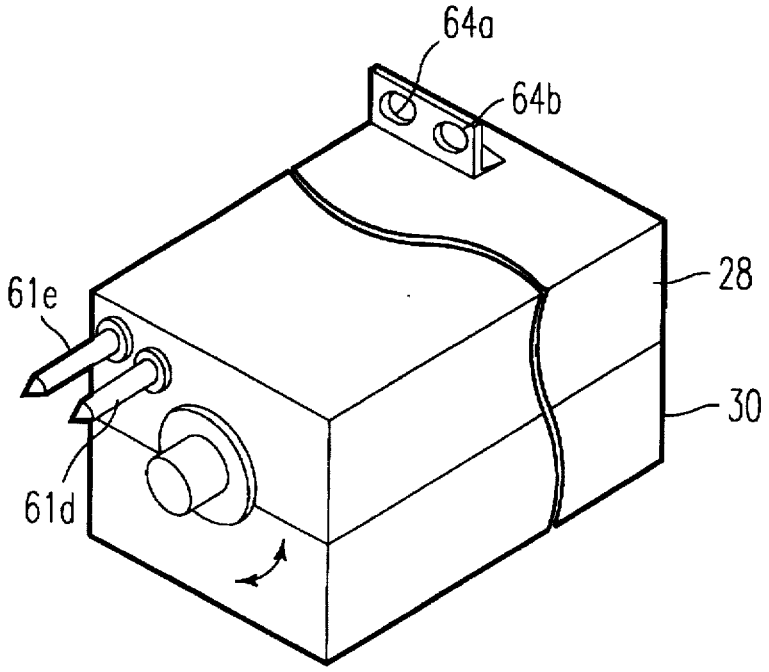

FIGS. 14 and 15 show less preferred embodiments of the invention.

As shown in FIG. 14, in the case that only one positioning pin 61*c* and one positioning hole 64*c* are provided, the positioning pin 61*c* and the positioning hole 64*c* thus become a fulcrum whereby the heat roller fixing device can swing and it is impossible to fix non-fixed images on paper sheets.

Also, it is desirable to provide plural positioning members in both the driving side and front panel side, i.e., that side having the brackets. However, if adjacent positioning pins 61*d*, 61*e* and positioning holes 64*d*, 64*e* are provided only at one side relative to the fixing roller as shown in FIG. 15, it is difficult to position the fixing roller unit to the main body. Further, as shown by an arrow in FIGS. 14 and 15 moments arising when the fixing roller 22 is rotated makes it difficult to position the fixing roller unit to the main body without vibration, In the preferred embodiment, on the other hand; since the positioning pins 61*a*, 61*b* are located at both side of the fixing roller 22 and on a diameter thereof (the horizontal line which passes through the center of the fixing device), and as far from one another as possible, as shown in FIG. 8, moments and vibration do not occur when the fixing roller 22 is rotated. The precision of positioning to the main body is therefore kept. The positioning holes 64*a*, 64*b* should also be located at both sides of a vertical line which passes through the center of the fixing roller 22 and at the same spacing as the positioning pins 61*a*, 61*b* when looking at in a direction by which the fixing roller unit 28 is inserted. But in the case that it is not possible to so locate them, the precision of positioning between the fixing roller 22 and the main body is maintained and vibration does not occur even when the fixing roller 22 is rotated, by providing the positioning pins or holes on parallel lines A and B or on parallel lines C and D.

Figure 10:
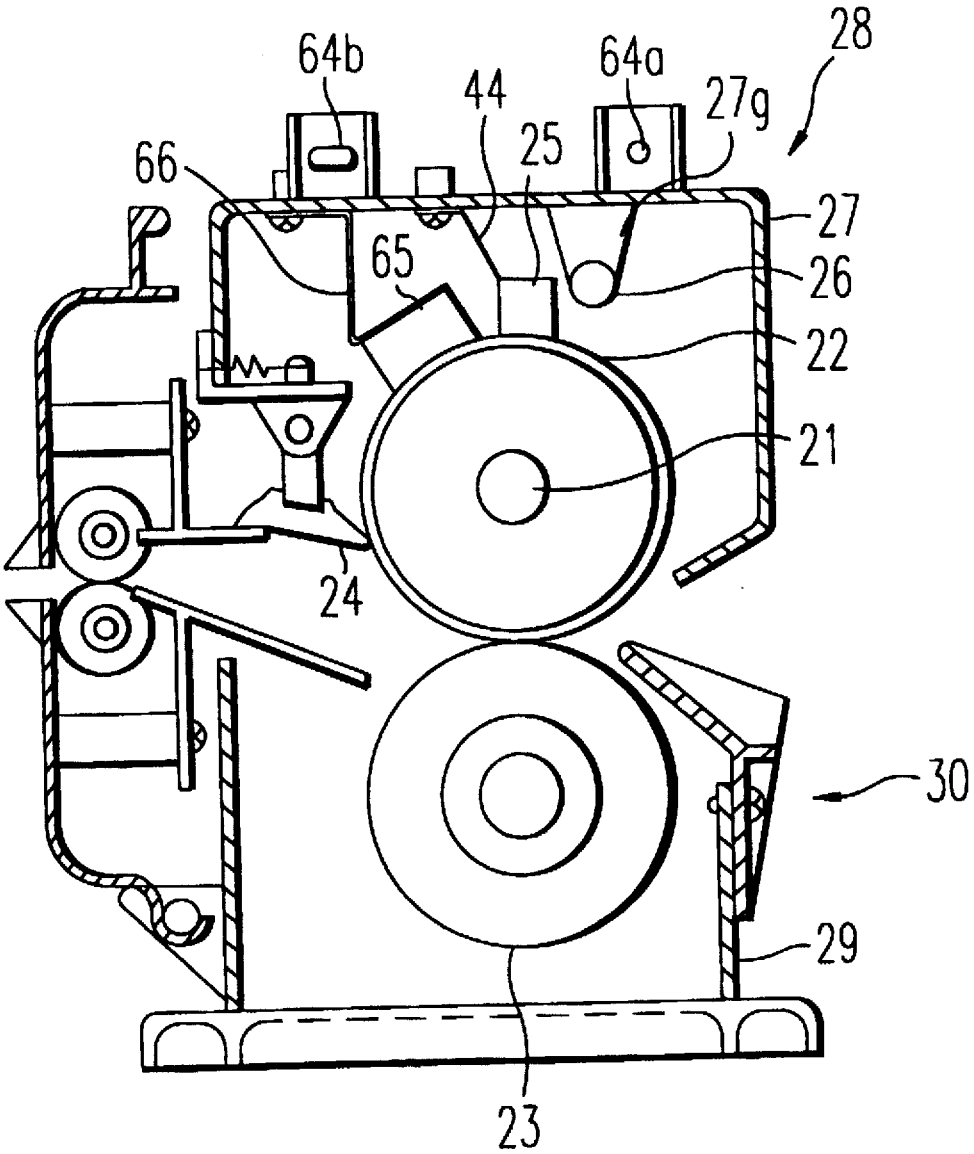
FIG. 10 is a longitudinal sectional front view of the fixing roller unit according to an alternate embodiment of the present invention.
Figure 11:
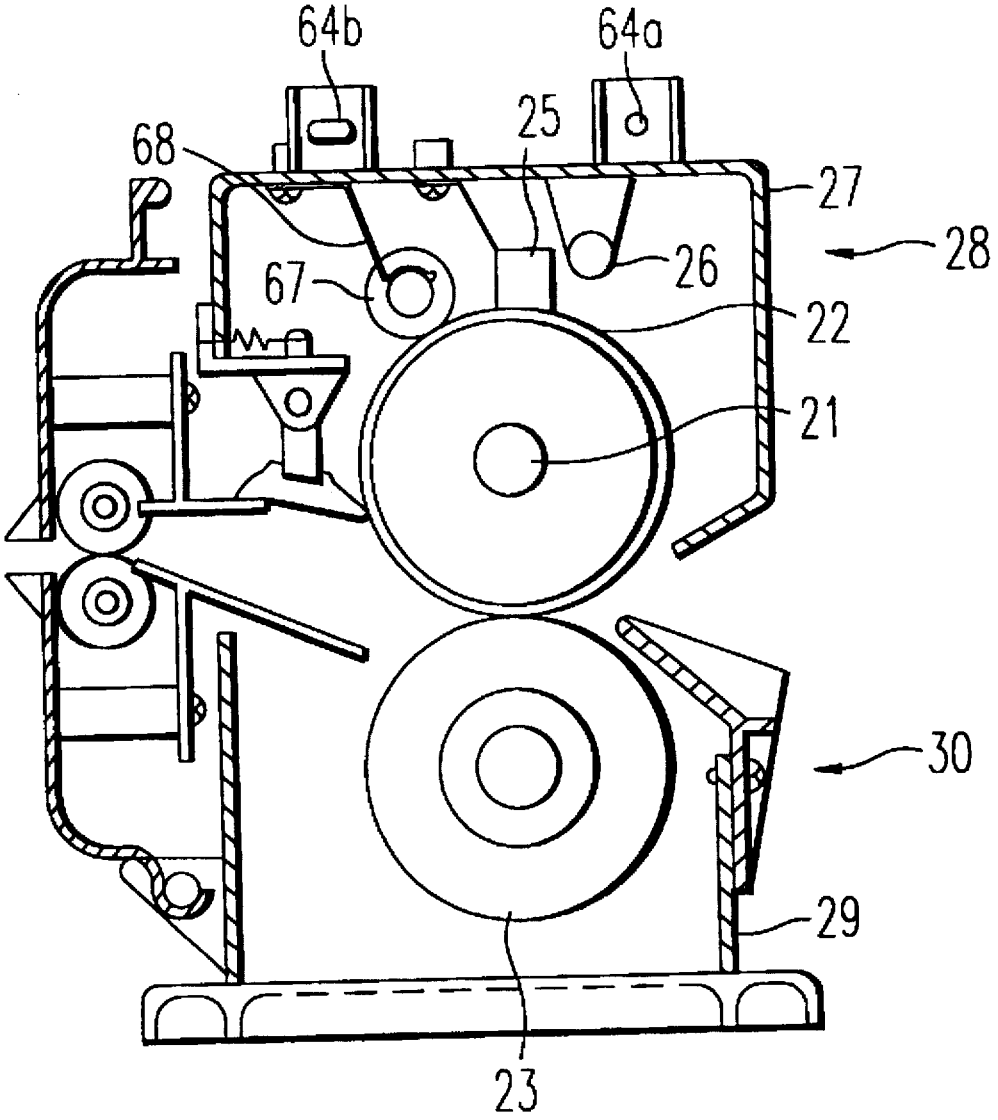
FIG. 11 is a longitudinal sectional front view showing a structure of the fixing device according to a further alternate embodiment of the present invention.
Figure 12:
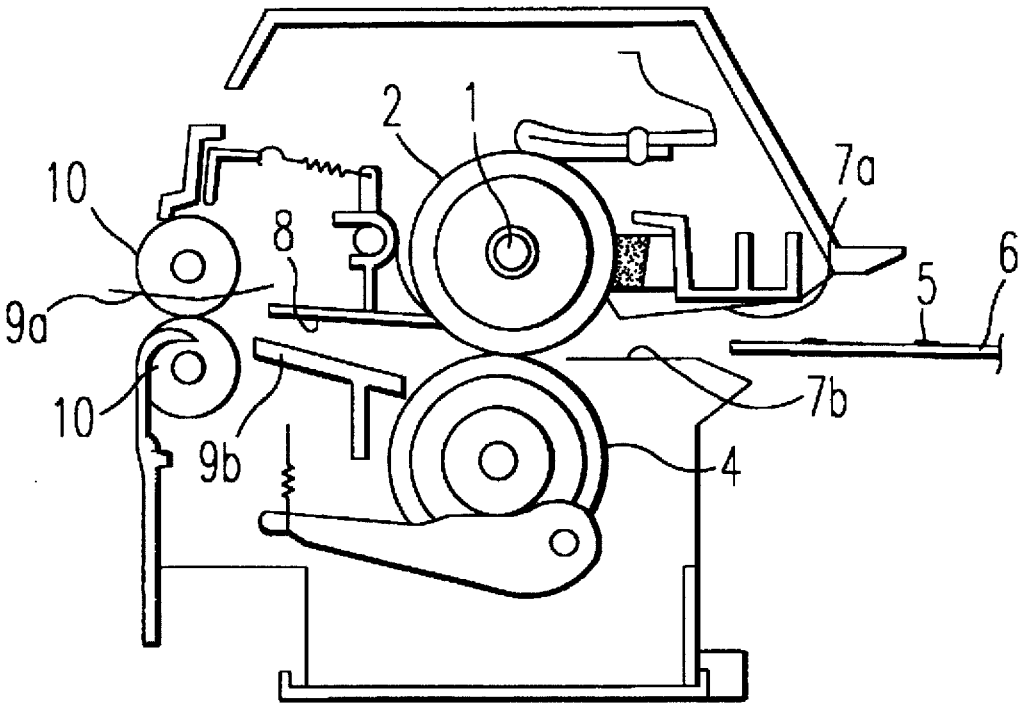
FIG. 12 PRIOR ART
FIG. 12 a longitudinal sectional front view showing a structure of a conventional fixing device.
Figure 13A:
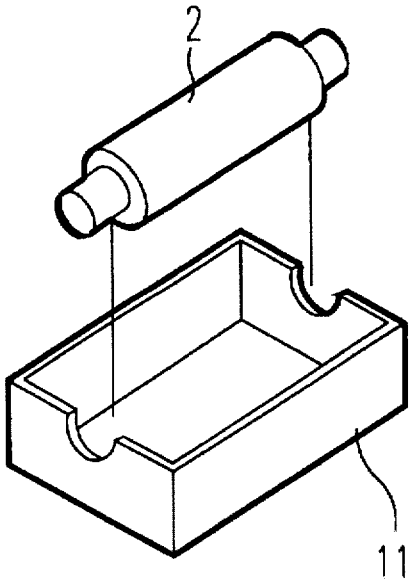
FIG. 13A PRIOR ART
FIGS. 13(*a*) and (*b*) together form an exploded perspective view of the components of a conventional fixing device.
Figure 13B:
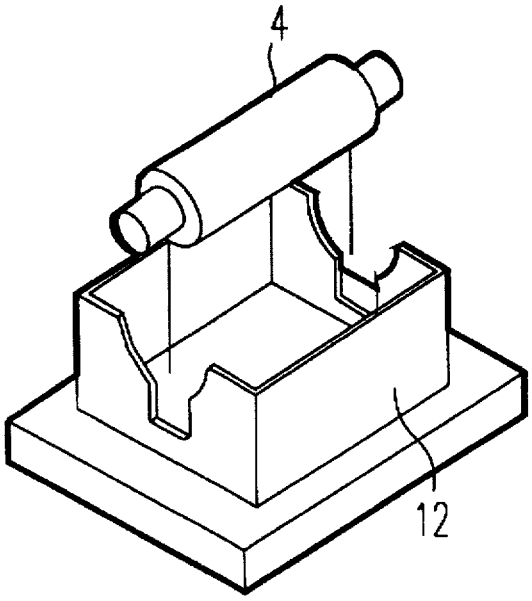
FIG. 13B PRIOR ART

As shown in FIG. 10, it is desirable that a cleaning felt 65 to be pressed on the fixing roller 22 is mounted on the upper face of the first frame 27 via a supporting member 66 which is a strip-shaped spring. Alternatively, as shown in FIG. 11, it is desirable that an oil supplying roller 67 is mounted on the upper face of the first frame 27 via a supporting member 68 in the fixing roller unit, in which the oil supplying roller 67 contacts and supplies oil on the surface of the fixing roller 22.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A heat roller fixing device in a recording device having a main body, said heat roller fixing device comprising:

a first unit including a heated fixing roller and a frame rotatably supporting the fixing roller;

a second unit mounted to said first unit and including a pressing roller and a frame rotatably supporting the pressing roller;

a driving element mounted at a driving side of said fixing roller; and two first positioning members provided on a side surface of said first unit at said driving side and at least one second positioning member provided on a top surface of said first unit, said first positioning members and said at least one second positioning member being engageable with the main body, said first positioning members being positioned substantially on a horizontal line passing through a center of the fixing roller, wherein a positioning of the first unit and the second unit mounted to the first unit relative to the main body is based on an engagement of said first positioning members and said at least one second positioning member with the main body.

2. A heat roller fixing device according to claim 1, wherein said fixing device has a front panel side located adjacent a front panel of the main body, wherein at least one of said second positioning members is provided in the front panel side.

3. A heat roller fixing device according to claim 2, wherein a number of said second positioning members in said front panel side is at least two.

4. A heat roller fixing device according to claim 3, wherein a plurality of said first and second positioning members are in both said driving side and said front panel side.

5. A heat roller fixing device according to claim 4, wherein said first positioning members in said driving side are provided at both sides of a vertical line which passes through a center of the fixing roller.

6. A heat roller fixing device according to claim 4, wherein a line which extends between said first positioning members in said driving side and a line which extends between said second positioning members in said front side are parallel.

7. A heat roller fixing device according to claim 4, wherein a line which extends between one of said first positioning members in said driving side and one of said second positioning members in said front panel side and a line which extends between the other of said first positioning members in said driving side and the other of said second positioning members in said front panel side are respectively parallel to an axis of the fixing roller.

8. A heat roller fixing device according to claim 1, wherein:

said first positioning members including first and second engaging portions, each of said first and second engaging portions being disposed symmetrically around an axis of the fixing roller; and said at least one second positioning member comprises engaging parts which are loosely engageable with corresponding engaging portions on the main body.

9. A heat roller fixing device in a recording device having a main body, said heat roller fixing device comprising:

a fixing roller in which a heater is built;

a pressing roller which rotatably presses on the fixing roller so that a non-fixed image may be fixed on a paper sheet in a nip between the fixing roller and the pressing roller;

a first frame rotatably supporting the fixing roller;

a second frame rotatably supporting the pressing roller and mounted to said first frame;

a temperature detector positioned for detecting a temperature on a surface of the fixing roller;

a safety device connected to said heater for preventing said temperature from exceeding a predetermined value;

a driving element mounted at a driving side of said fixing roller;

two first positioning members provided on a side surface of said first frame at said driving side and at least one second positioning member provided on a top surface of said first frame, said first positioning members and said at least one second positioning member being engageable with the main body, said first positioning members being positioned substantially on a horizontal line passing through a center of the fixing roller, wherein a positioning of the first frame and the second frame mounted to the first frame relative to the main body is based on an engagement of said first positioning members and said at least one second positioning member with the main body;

a connector electrically connectable to the main body; and a harness electrically connected between said heater and said connector;

wherein said detector, said safety device, said connector and said harness are provided on said first frame.

10. A heat roller fixing device according to claim 9, each one of said first positioning members being provided on opposite sides of said fixing roller such that an axis of each one of said first positioning members is parallel to a rotational axis of said fixing roller.

11. A heat roller fixing device according to claim 10, wherein said at least two first positioning members and said fixing roller are in the same plane.

12. A heat roller fixing device according to claim 9, wherein at least two of said second positioning members are provided on the top surface of said first frame, each one of said at least two second positioning members being provided on opposite sides of a rotational axis of said fixing roller.

13. A heat roller fixing device according to claim 9, wherein:

said positioning members including first and second engaging portions, each of said first and second engaging portions being disposed symmetrically around an axis of the fixing roller; and said at least one second positioning member comprises engaging parts which are loosely engageable with corresponding engaging portions on the main body.

* * * * *

UNITED STATES PATENT AND TRADEMARK OFFICE

CERTIFICATE OF CORRECTION

PATENT NO. : 5,729,798
DATED : March 17, 1998
INVENTOR(S) : Motokazu YASUI, et al.

It is certified that error appears in the above-identified patent and that said Letters Patent is hereby corrected as shown below:

On the title page, item [45] should be:

--[45] Date of Patent: *Mar. 17, 1998--

On the title page, item [*] has been omitted, it should be:

--[*] Notice: The term of this patent shall not extend beyond the expiration date of Pat. No. 5,481,350.--

Signed and Sealed this

Nineteenth Day of May, 1998

Bruce Lehman

*Attest:*

BRUCE LEHMAN

*Attesting Officer*

*Commissioner of Patents and Trademarks*